US006042523A

United States Patent [19]

Graham

[11] Patent Number: 6,042,523

[45] Date of Patent: Mar. 28, 2000

[54] THERAPEUTIC EXERCISE APPARATUS AND METHOD

[76] Inventor: Gary A. Graham, 10005 Mt. Baker Hwy., Glacier, Wash. 98244

[21] Appl. No.: 09/092,462

[22] Filed: Jun. 5, 1998

Related U.S. Application Data

[60] Provisional application No. 60/048,957, Jun. 6, 1997.

[51] Int. Cl.[7] ..... A63B 22/00

[52] U.S. Cl. ..... 482/121; 482/121; 482/122; 482/123; 482/79

[58] Field of Search ..... 482/121, 122, 482/123, 130, 95, 96, 79

[56] References Cited

U.S. PATENT DOCUMENTS

| | | | |
|---|---|---|---|
| 2,340,666 | 2/1944 | Johanson | 482/79 |
| 2,664,886 | 1/1954 | Coffman . | |
| 3,620,530 | 11/1971 | Cosby | 272/82 |
| 4,004,801 | 1/1977 | Campanaro et al. | 272/120 |
| 4,561,649 | 12/1985 | Forsythe . | |
| 4,706,953 | 11/1987 | Graham | 272/120 |
| 4,869,499 | 9/1989 | Schiraldo . | |
| 5,039,093 | 8/1991 | Collier . | |
| 5,042,797 | 8/1991 | Graham | 272/120 |
| 5,066,005 | 11/1991 | Luecke | 272/136 |
| 5,260,870 | 11/1993 | Tsuchiya et al. | 364/413.02 |
| 5,279,530 | 1/1994 | Hess | 482/70 |
| 5,312,315 | 5/1994 | Mortensen et al. | 482/113 |
| 5,318,495 | 6/1994 | Malynowsky . | |
| 5,499,958 | 3/1996 | Hess . | |
| 5,599,260 | 2/1997 | Rovinsky et al. . | |
| 5,645,516 | 7/1997 | Foster . | |

*Primary Examiner*—Jerome W. Donnelly
*Assistant Examiner*—Tam Nguyen
*Attorney, Agent, or Firm*—Robert B. Hughes; Hughes & Schacht, P.S.

[57] ABSTRACT

A therapeutic exercise machine particularly adapted for restoring and/or maintaining the range of motion for post operative patients and for general therapeutic use. There is a carriage assembly mounted for back and forth longitudinal motion along a support frame. A plurality of tensioning cords urge the carriage frame to a forward location, and there is a contact plate mounted to the carriage frame. The person using the machine presses his or her feet or hands against the contact plate and moves it back and forth against the force of the tensioning cords. The tensioning cords are arranged so that there is an operating end that can be selectively attached to the front of the frame or to the carriage frame to vary the magnitude of the tensioning force.

23 Claims, 10 Drawing Sheets

14
36
48
50
134
20
102
52
42
38
100
98
94
124
40
44
a
96
104
106
108
110
46
116
18
122
118
54
56
120
12
16
20

THERAPEUTIC EXERCISE APPARATUS AND METHOD

This application claims priority from Provisional Application Ser. No. 60/048,957 filed Jun. 6, 1997.

BACKGROUND OF THE INVENTION

A) Field of the Invention

The present invention relates to a therapeutic exercise device and more particularly a convenient exercise devise which is particularly adapted for restoring and/or maintaining the range of motion of post-operative patients and also having general therapeutic use.

B) Background of the Invention

There have existed for a number of years exercise apparatus where there is a support frame, and a support platform which is movable along the length of the support frame. In one such apparatus, the person is positioned with his or her back resting on the support frame, and the person's feet are placed against an upright plate, and the person pushes with his or her legs to be propelled away from the plate. Tension cords are provided to pull the carriage back toward the plate, with a person again propelling himself away from the plate. There is also a need for an exercise apparatus which is more adapted for therapeutic needs. For example, there is a current need for restoring and maintaining the range of motion for postoperative patients. Rapid functional improvement could be realized by lower extremity injury patients working on a horizontal, or near horizontal plane. By utilizing control concentric and eccentric closed chain exercises, the patient is able to focus on increasing his/her range of motion, strength and stability.

SUMMARY OF THE INVENTION

The present invention was designed particularly to serve the patient in the period between surgery and his/her ability to bear partial weight. Thus, it was developed to provide simple, quality movement, by range of motion, shortly after surgery and expand into a low level exercise program. Also, the present invention is arranged so that it could be used in a person's bed, on the floor, sitting in a chair or wheel chair, on a treatment table, or even a normal table.

Further, the present invention can be used in a variety of clinical, institutional, athletic and specialized settings, enabling a wide variety of exercise to be accomplished with this apparatus. The apparatus of the present invention comprises a support frame having a front end, a rear end, and a longitudinal axis. The support frame comprises a longitudinally extending rail means.

There is a carriage assembly comprising a carriage unit mounted to the support frame and engaging the rail means for back and forth travel along the longitudinal axis. The carriage assembly also comprises a contact member mounted to the carriage unit and adapted to be engaged by a person to exert a rearwardly directed force on the contact member. The carriage unit has a front end and a rear end. It comprises carriage housing and a rail engaging support means for back and forth travel.

There is also a tensioning system arranged for operative engagement between the carriage assembly and the support frame to exert a forward force on the carriage assembly to urge the carriage assembly in a forward direction. This tensioning system comprises a plurality of selectively operable elastic tension cords, each having an anchor end and an operating attachment end by which the operating end can be manipulated and attached.

There is a cord attaching means located at the forward end of the carriage assembly and comprising a first attaching portion to hold the anchor ends of the cords at a forward anchoring location on the carriage assembly and a second stowing attachment portion to engage selectively the operating attachment ends of the cords at selectively engaged stowing locations at the forward end of the carriage, A pulley section at the rear end of the carriage unit comprises a plurality of pulleys, engaging related cords. The cords extend from the forward anchoring location rearwardly to extend around the related pulleys and then forwardly from the pulleys to a forward location of the carriage unit. There is a third selectively engaged operating attaching means mounted at a front end location of the support frame to connect selectively to the operating ends of the cords.

Thus, the operating ends of the cords can be attached to the second attaching portion of the cord attaching means so that the cords are in a stowed position in the carriage assembly, and one or more of the operating ends of the cords can be detached from the second attaching portion and engaged with the third selectively engaged operating attaching means. Thus, when a person is utilizing the apparatus by pushing against the contact member to move the carriage assembly rearwardly, the one or more tension cords attached to the third attaching means exert a tension force on the carriage assembly to return the carriage assembly to a more forward location.

In the preferred form, the contact member comprises a contact plate which is adjustably mounted to the carriage housing so as to be able to be positioned at various angular positions. The plate is pivotally mounted at the forward location of the carriage housing, and the plate can be moved angularly in an upward or downward direction from the pivot location. A plate positioning means holds a plate at selected angular locations.

The apparatus further comprises stabilizing cord means having one end attached to the support frame, and a second end having connecting means adapted to be connected to a stationary structure so as to position the apparatus at a stationary operating location. The stabilizing cord means comprises a pair of stabilizing cords connected at forward locations on the support frame on opposite sides thereof. In the preferred form, the stabilizing cords have a length and adjustment means incorporated therein so that the cords can be connected to structures adjacent to the person operating the exercise apparatus.

The rail means comprises a pair of laterally spaced rail members, each having upwardly and downwardly directed generally horizontal positioning surfaces to engage the rail engaging means of the carriage to limit vertical movement of the carriage assembly relative to the support frame.

In the preferred form the rail engaging support means comprises first and second wheel means on opposite sides of the carriage unit to engage the upward and downwardly directed surfaces of the rail means. In a preferred form, the first and second wheel means each comprise a pair of longitudinally spaced support wheels which engage the upwardly directed surface of its related rail member, and a stabilizing wheel positioned between the first and second wheels that engages the downwardly directed surface of its related rail member. In a specific arrangement, each of the upwardly directed surfaces of the two rail members comprises an upwardly and outwardly directed support surface portion providing laterally stabilizing forces to the wheels.

In another embodiment, the rail engaging support means comprises first and second laterally spaced slide block means, with each of the slide block means comprising first and second longitudinally spaced slide blocks having upwardly and downwardly directed contact surfaces to engage, respectively, the downwardly and upwardly directed positioning surfaces of the rail members, said slide block means frictionally engaging the rail members.

The cord attaching means of the tensioning system comprises an attaching structure having attaching slots for the cord ends, each attaching slot being sized to permit its related cord to pass therethrough. Each slot has first and second enlarged openings, and the anchor end of each cord has an enlarged end portion which is sized to engage the edge portions of the attaching structure surrounding the opening to attach the anchor end of the cord to the attaching structure. The operating end of each cord also has a sufficiently large end portion to become engaged in the second opening of the attaching structure and to retain the operating end at the position of the second opening.

Each of the slots has a third opening which is aligned so that with the operating end of this related cord being positioned in the third attaching means, lateral movement of the cord is restrained by the third opening means.

The attaching structure is mounted to the forward end of the carriage housing to extend downwardly therefrom, and the slots comprise downwardly extending slots, having an open lower end, with the first and second openings being vertically aligned with one another, said third attaching means having upwardly open slots, with enlarged openings formed therein. The enlarged openings of the third attaching means are in longitudinal alignment below the second openings of the attaching structure of the carriage assembly.

In the method of the present invention, the apparatus is provided as above. One or more of the tensioning cords are placed in the operating position, and the person positions himself so That his (her) foot or feet are positioned in engagement with the contact plate, or possibly the persons hands are placed in that position. Then the contact plate is moved rearwardly against the force of the tension cord(s) and permitted to return.

When the exercise session is complete, the tension cords are returned to their stowed position. Also, the stabilizing cords are utilized to properly position the apparatus during exercise.

Other features of the present invention will become apparent from the following detailed description.

DESCRIPTION OF THE PREFERRED EMBODIMENTS

Figure 1:
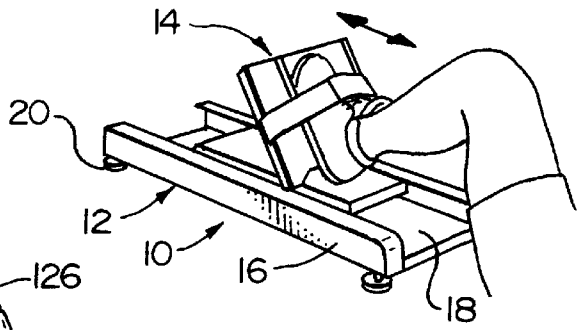
FIG. 1 is an isometric view showing the apparatus of the present invention where a person is using the apparatus to exercise his left leg.
Figure 2:
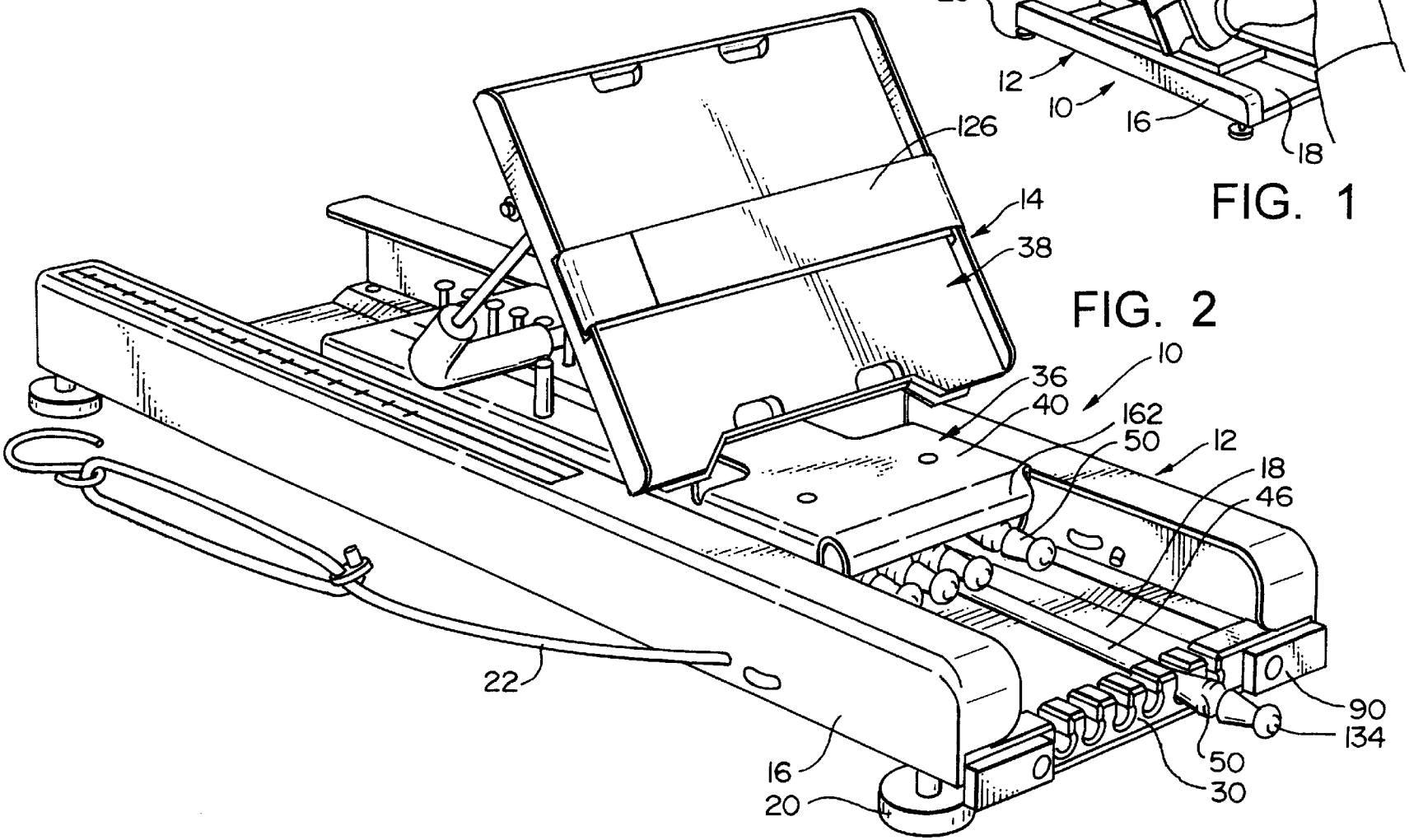
FIG. 2 is also an isometric view of the apparatus of the present invention, but drawn to a larger scale and shown in more detail.

The apparatus 10 of the present invention is shown in one operating mode in FIG. 1, and in more detail in FIG. 2. This apparatus 10 comprises a support frame 12 and a carriage assembly 14 which is mounted to the frame 12 for back and forth motion thereon. As can be seen more clearly in FIG. 3, the support frame 12 comprises a pair of laterally spaced side rails 16 which are joined to one another by a connecting structure 18 extending between lower sides of the side rail 16. Four corner support members 20 support the frame 12, and there is a pair of stabilizing cords 22 connected to the side rails 16.

The support frame 12 has a front end 26 and a far side rear end 28. At the front end 26 there is a laterally extending tension cord holding member 30. For purposes of description, the apparatus 10 will be considered as having a longitudinal axis 32, and a transverse axis 34 (See FIG. 3). The carriage assembly 14 comprises a carriage unit 36 and a contact plate 38. The carriage unit comprises a carriage housing 40, a track engaging support means 42, and a tensioning system 44 (See FIGS. 4, 5, and 6).

To describe at this time briefly the operation of the components described thus far, the carriage assembly 14 is mounted by the track engaging support 42 (in the form of wheals) to move back and forth along the longitudinal axis 32. As will be described later herein, the tensioning system 44 has a stowed position (shown in FIG. 5) and an operating position (shown in FIG. 6). In the operating position of FIG. 6, the carriage unit 36 is resiliently urged to its more forward position adjacent to the front end (front end) 26 of tho apparatus 10.

In the operating position (See FIG. 2), the contact plate 38 is tilted upwardly at the desired angle. The person places his feet (or possibly one foot, as shown in FIG. 1) against the contact plate and the entire carriage assembly 14 is pushed rearwardly by the person using the apparatus 10 and then permitted to return to its more forward position.

The tensioning system 44 comprises a plurality of elastic tensioning cords 46, each having an anchoring end 48 and an operating end 50. Further, there is an attaching plate 52 at the front end of the carriage housing 40. The anchor end 48 of each tensioning cord 46 is fixedly connected to attaching plate 52, while the operating end 50 of each tensioning cord 46 is selectively positioned in the attaching plate 52 in the stowed position (See FIGS. 4 and 5) and then can selectively be attached to the tension cord holding member 30.

Figure 4:
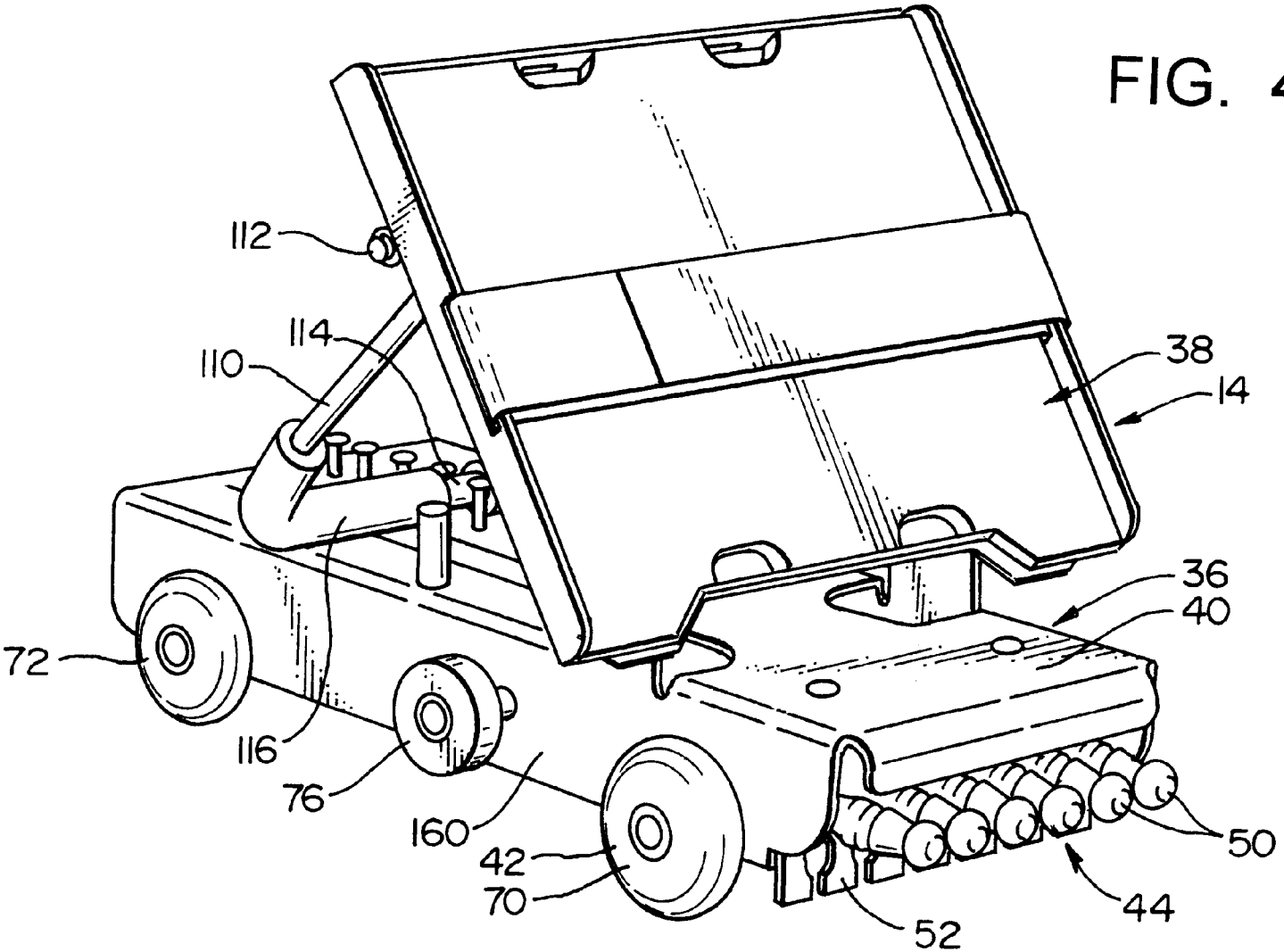
FIG. 4 is an isometric view showing the carriage assembly.
Figure 5:
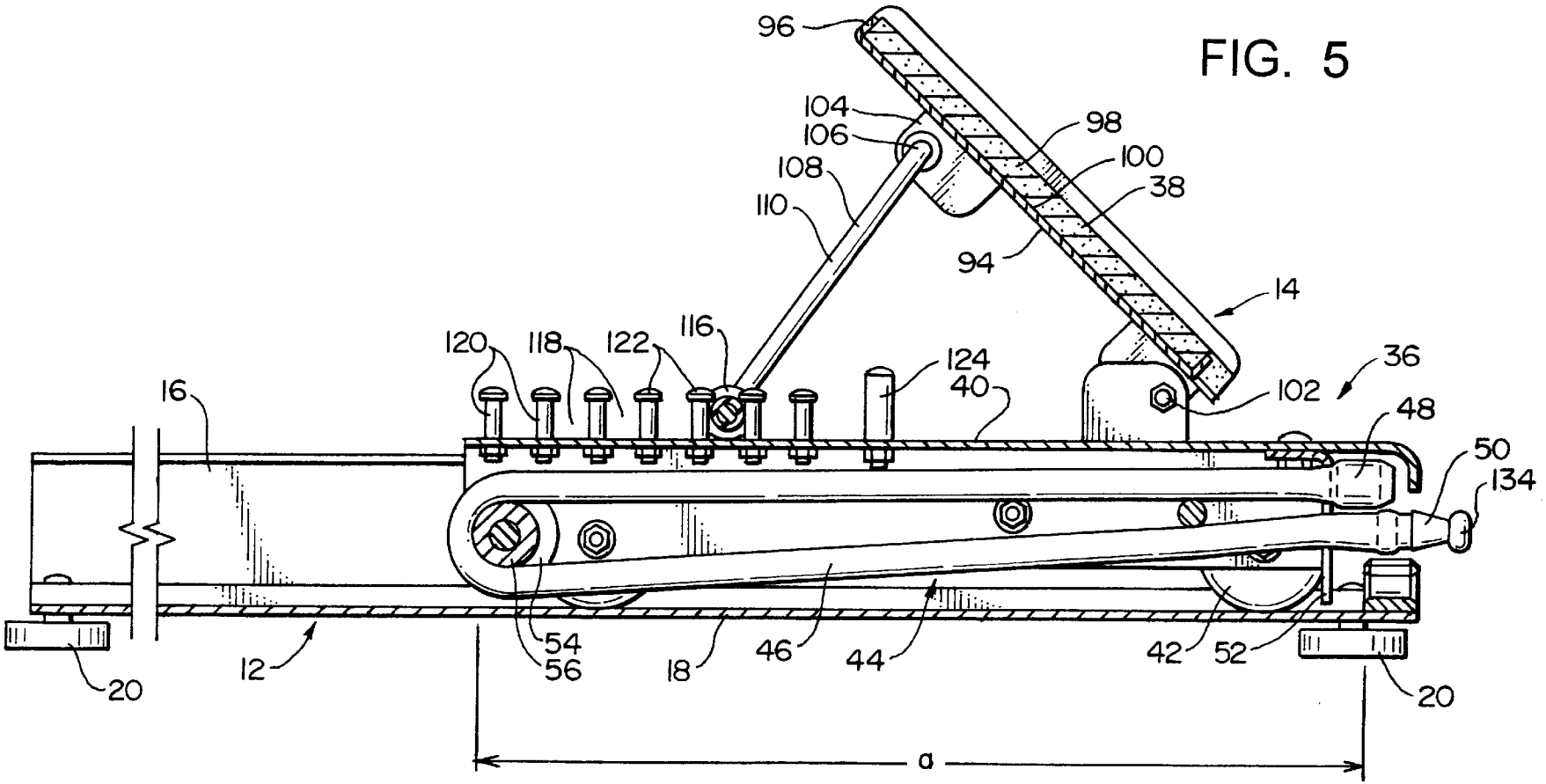
FIG. 5 is a longitudinal view, partly in section, showing the apparatus in its stored position where the tension cords are attached in their stored position.
Figure 6:
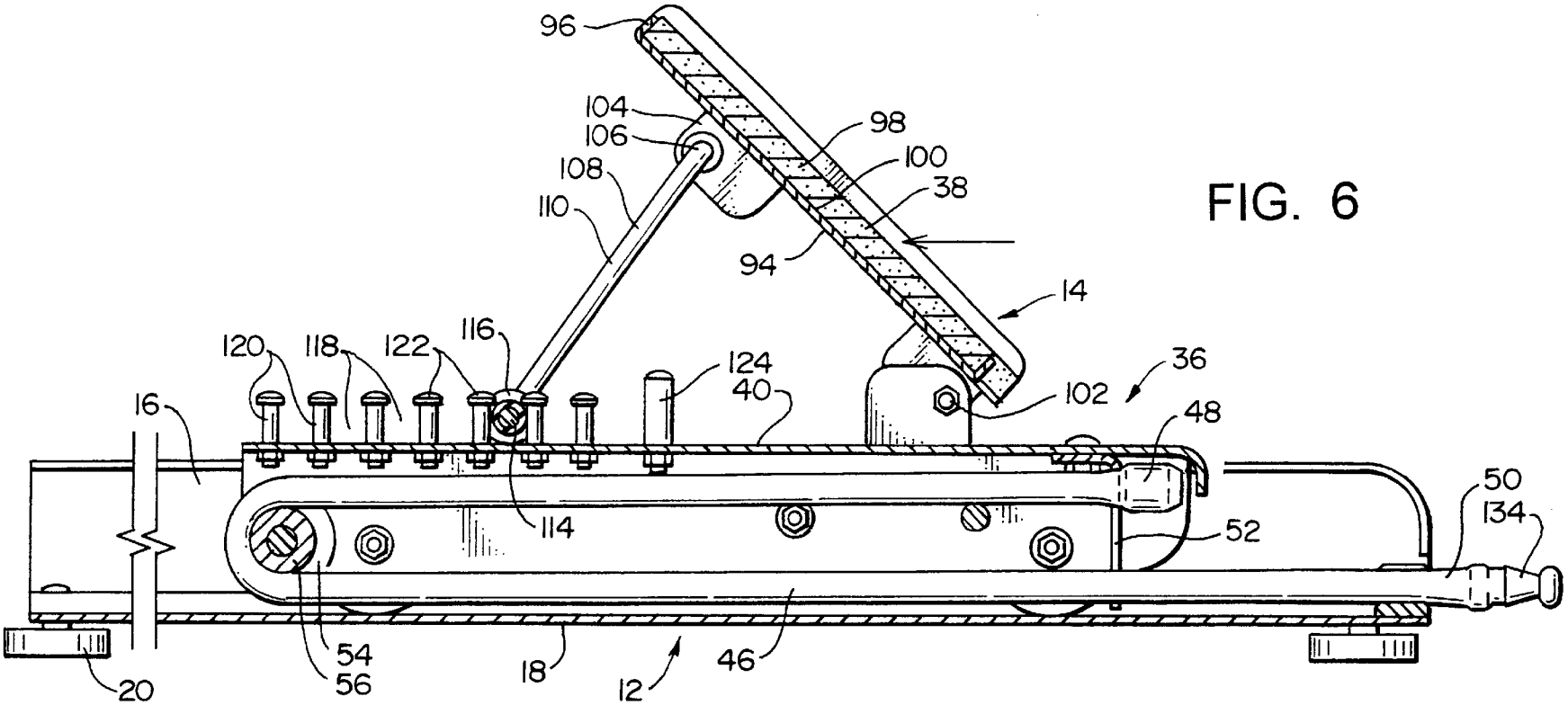
FIG. 6 is a sectional view similar to FIG. 5, showing the apparatus in its operating mode, with the tension cords engaging the anchoring means of the frame.

At the rear end of the carriage housing 40, there is a pulley set 54, made up of a plurality of laterally spaced pulleys 56, each pulley engaging a related tensioning cord 46 (See FIGS. 5 and 6). In FIGS. 4 and 5, the operating ends 50 of the tensioning cords 46 are shown at the stowed position in the attaching plate 52. In this position, the carriage assembly 14 can move freely back and forth in the frame 12. When one or more of the tension cords 46 have their operating end connected to the tension cord connecting member 30, the cord or cords that are connected to the tension cord connecting member 30 function to yieldingly urge the carriage assembly 14 back to its forward position, The arrangement and function of the tensioning system 44 in cooperation with the other components of the present invention is considered to be particularly significant. This tensioning system 44 comprises generally the aforementioned components 46–56, and also the tension cord holding member 30 that is mounted to the forward end of the support frame 12. The tensioning system 44 will be discussed in more detail later herein.

There will now be a more detailed discussion of the various components of the present invention.

Figure 3:
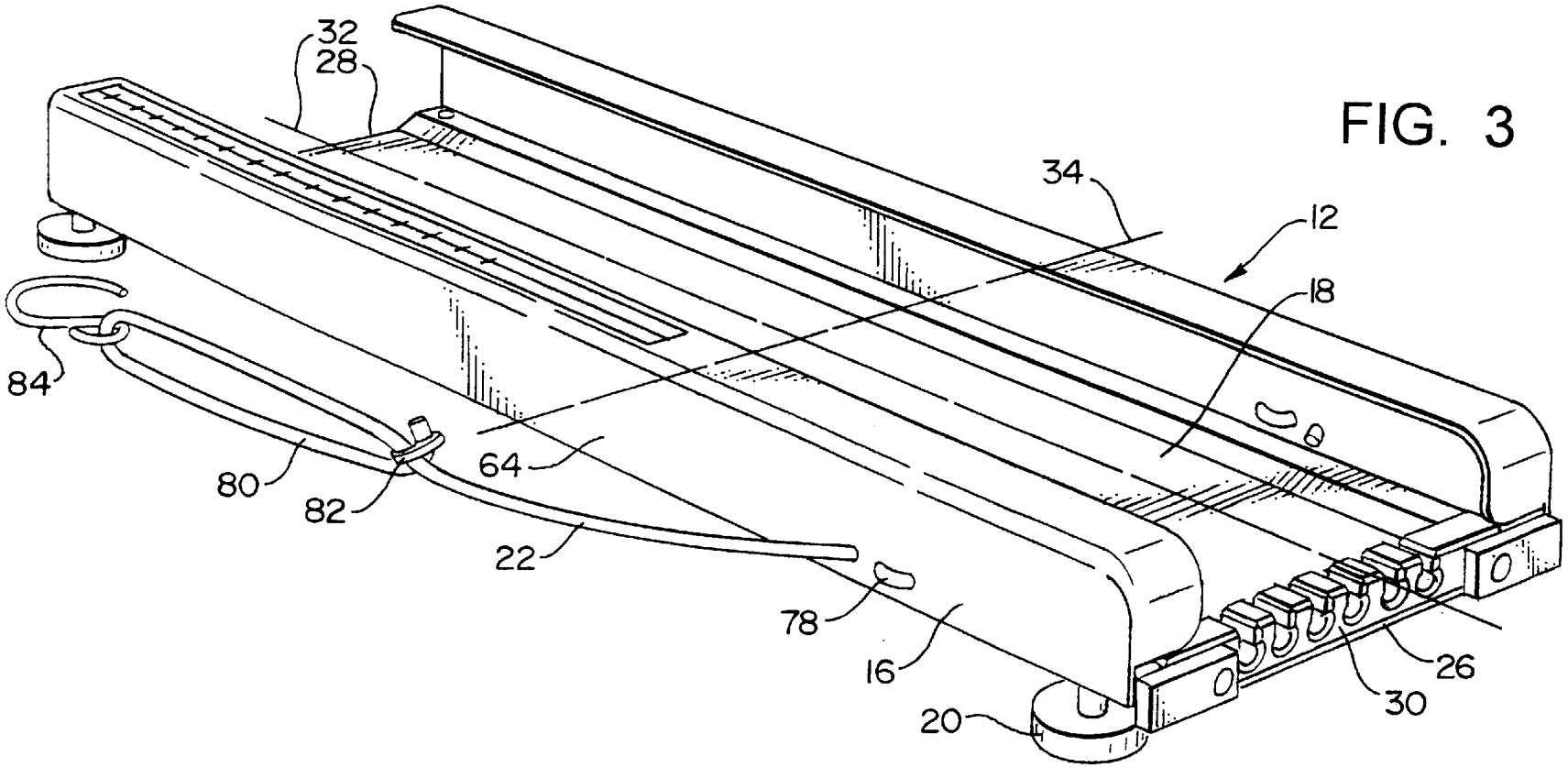
FIG. 3 is an isometric view showing the support section of the apparatus.
Figure 9:
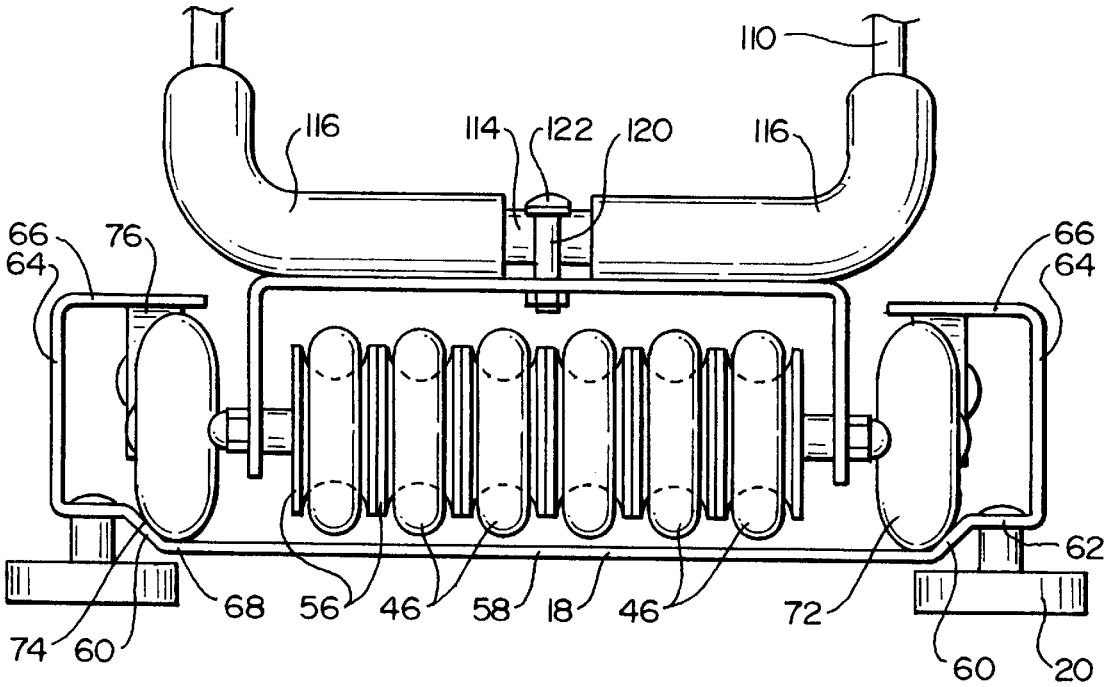
FIG. 9 is a rear view taken at the near end of the apparatus.
Figure 11:
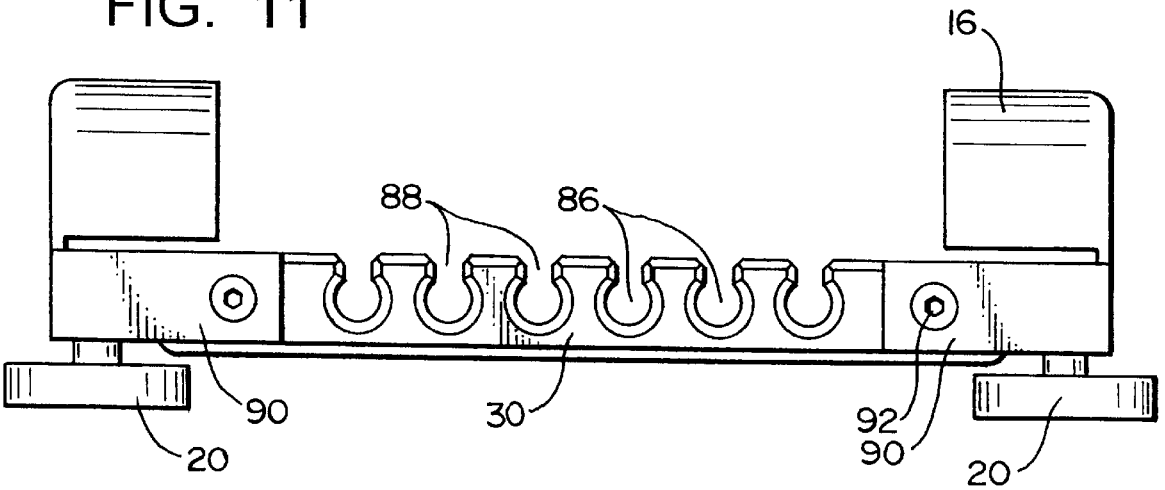
FIG. 11 is an end view of the support frame operating connecting plate.

To describe the support frame 12 in more detail, reference is made to FIGS. 3, 9 and 11. The support frame 12, in terms of function, comprises the aforementioned side rails 16 and the connecting structure 18. In the present invention, the side rail 16 and connecting structure 18 are formed as a unitary structure from a plate of aluminum or other metal (See FIG. 9). More particularly, the connecting structure 18 comprises a lower horizontal plate 58, and the lateral longitudinal edges 60 extend from the edge of the plate 58 upwardly and outwardly at a 45 degree angle to join to a horizontal edge portion 62, which in turn connects to a laterally outward vertical plate portion 64 which in turn joins to an inwardly extending horizontal flange 66. The slanted edge plate portions 60 actually function as part of the rail members 16 in conjunction with the adjacent outer edge portion 68 of the plate 58. Also, the two upper flanges 66 function as part of the side rails 16.

Figure 7:
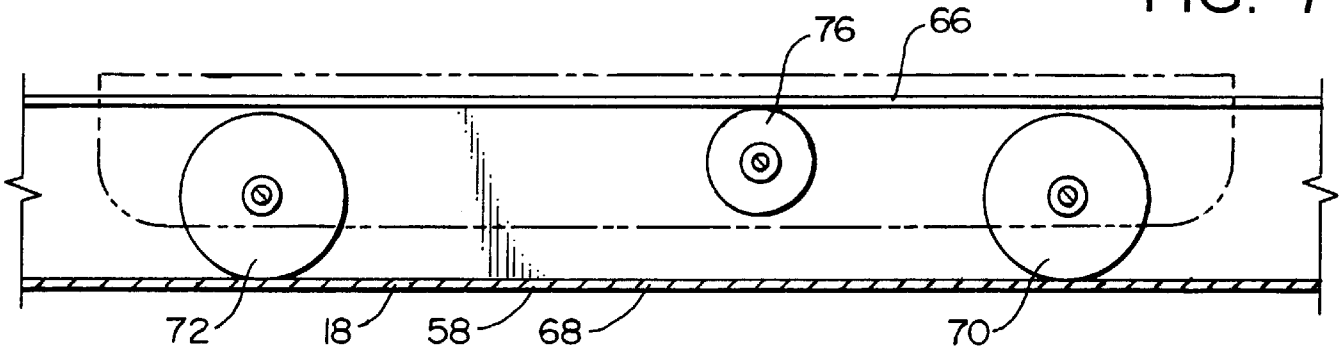
FIG. 7 is longitudinal sectional view of the carriage and the support frame, and showing the positioning of the wheels.

To describe this further, reference is made to FIGS. 4 and 7. The track engaging support 42 in this first embodiment comprises two sets of wheels. In each set there are front and rear side wheels 70 and 72, respectively, and it can be seen in FIG. 9 that the circumferential edges 74 of the wheels 70 and 72 are, in circumferential cross section, circumferentially contoured at 74 so that the circumferential edges engage both the bottom plate portion 68 and the slanting plate portion 60 to properly align both the front and rear wheels 70 and 72. Also, there is another pair of side wheels 76 positioned between the wheels 70 and 72, and each of these wheels 76 engages the upper flange member 66. Thus, as can be seen in FIG. 7, the site of wheels 70, 72 and 76 cause the carriage unit 36 to reliably track to the support frame 12 without any vertical or laterally wobbling motion.

The aforementioned stabilizing cords 22 are shown in FIGS. 2 and 3. Each cord is secured by one end at 78 to the side wall 64 of the support frame 12 a short distance rearwardly of the front end 26 of the frame 12. The cord 22 extends in a loop 80 and connects to a simple adjusting member 82 which can be used to either enlarge the loop 80 (and thus shorten the effective life of the cord 22) or make the loop 80 smaller to extend the length of the cord 22. Each loop 80 is attached to an S shaped hook member 84. These hooks 84 can be attached to various stationary members to locate the apparatus 10 in the desired position. For example, if a person is sitting in a chair and utilizing the apparatus 10, then the hooks 84 can be attached to the legs of the chair so that the apparatus remains in place as the person pushes his or her feet against the contact plate 14. If the person is lying on his or her back and using the apparatus 10, then the hooks 84 could be attached to some other nearby stationary member, or possibly even be grasped by the person to stabilize the location of the apparatus 10.

The aforementioned Tension cord holding member 30 can best be seen in FIGS. 2, 3 and 11. This is formed as a plastic block, having a plurality of circular recesses or openings 86 formed therein, with each recess having a "necked down" upper slot or entryway 88. This cord holding member 30 is mounted to the forward end of the frame 12. As will be disclosed later herein, tho operating end 50 of each tension cord can be inserted in its related recess 86 so that the tensioning cord 46 can be reliably held in its operating position, as shown in FIGS. 2 and 6.

As shown in FIG. 11, the tension cord connecting member 30 is provided with two end members 90 rotatedly mounted about a bolt connection 92. Each of these members 90 can be rotated 180 degrees from the position shown in FIG. 11 to cover a related one of the connecting openings 86. This could be done, for example, if for some reason it is desired to limit the number of cords which could be attached to the tension cord connecting member 30.

Attention is now directed to the carriage assembly 14. The aforementioned contact plate 38 comprises a metal plate member 94 having perimeter flange portions 96 surrounding a pad 98 that is positioned on the upwardly/forwardly facing contact surface 100 of tho plate 94. The plate 94 is hinge mounted at its lower/forward end at a pivot location 102, and has at its upper back surface a pair of bracket members 104 by which the plate 94 is pivotally attached at 106 to a positioning member 108.

This positioning member 108 is a U shaped member comprising a pair of arms 110, which have laterally outturned end portions 112, each of which pivotally engages a related bracket 104. The positioning member 108 also comprises a cross bar 114 connecting to the swing ends of the two arms 110. It will be noted that the side portions of the cross bar 104 are provided with a pair of padded sleeves 116 that engage the top surface of the carriage housing 40. The center part of the cross bar 114 is sized to fit snugly in one of the selected slots 118 that are defined by a row of longitudinally spaced upstanding posts 120. It can be seen that by moving the cross member 114 into different slots 118, the slant of the contact plate 94 can be varied, The top ends of the posts 120 are capped with rubber retaining members 122 to resiliently hold the cross bar 114 in place. In the stowed position, the U shaped member 108 is pulled out of engagement with the post 120 and extended rearwardly, with the plate 94 resting upon two support posts 124. A retaining strap 126 is placed over the pad 98. An additional strap such as a heel strap or straps could also be added.

To describe the tensioning system 44 of the present invention, reference is made to FIGS. 5–10. The main components of the tensioning system 44 were described previously, these being the tensioning cords 46 having the two end portions 48 and 50, the positioning plate 52, the pulley set 54 through pulleys 56, and also tension cord connecting member 30 that is mounted to the front end of the support Frame 12.

Figure 8:
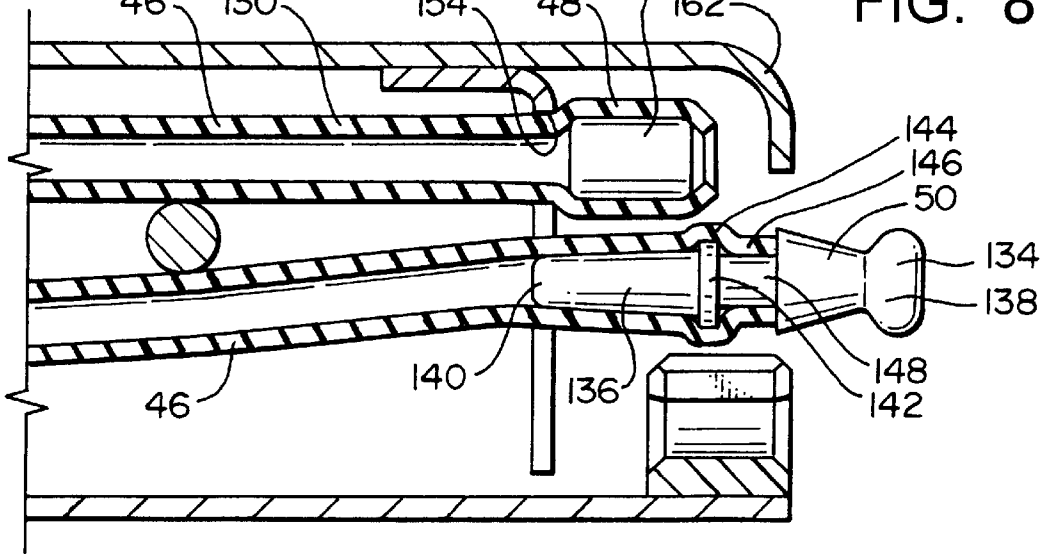
FIG. 8 is a longitudinal sectional view showing the forward portion of the apparatus, and showing the tensioning cords in more detail in their stowed position.

To describe further details of the tensioning system, reference is made specifically to FIG. 8. Each tensioning cord 46 is made of a tubular elastic material 130. The anchor end 48 is made by inserting an expanded plug member 132 in the end of the tube 130 and bonding the plug 132 in the cord 130.

The operating end 50 of each cord is provided with an end handle or knob 134 that has a mounting portion 136 and a handle portion 138. The mounting portion 136 has a rearwardly tapered end portion 140 having an expanded circumferential collar or flange 142 which extends outwardly to come into what might be termed a gripping engagement with the adjacent part 144 of the tube 46. Then the very end of the tube extends rearly inwardly at 146 to grip a more forward portion 148 of the mounting portion of the handle 138.

Figure 10:
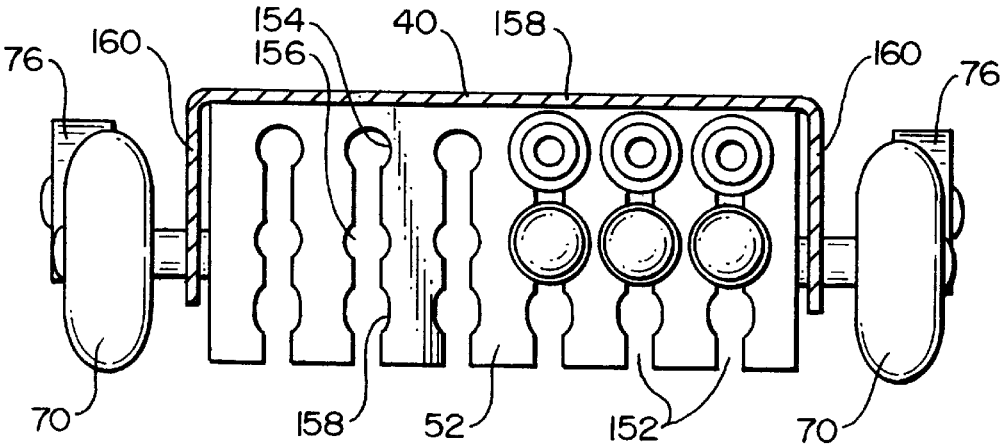
FIG. 10 is an end view of the carriage unit, taken at a position looking toward the front end of the carriage.

The positioning or attaching plate 52 can best be seen in FIG. 10. There are six vertical slots 152, and each slot 152 has three vertically spaced expanded open portions that are circularly curved, the uppermost opening being designated 154, the middle opening 156 and the lowermost opening 158 (with the opening 158 being somewhat elongated from the circular configuration in a vertical direction.

The anchoring end 148 of each cord 46 is permanently located its related upper opening 154, and during the operation of the machine, this anchoring end 48 remains securely in place. Normally, it would only be moved for repair, etc.

The middle opening 156 is the stowing opening, and as can be seen in FIG. 8, the operating end 50 of the cord 46 is shown inserted in that slot. The lowermost opening 158 in each slot 152 is an alignment opening through which the cord 46 extends when it is in its operating position (i.e. when the operating end is positioned in the openings 86 of the connecting member 30).

The aforementioned carriage housing 40 comprises an upper plate 160, and two side walls 160. Also, the front edge 162 of the carriage housing 40 is extended forwardly a short distance and turned downwardly in a 90 degree curve to at least partially enclose the anchoring ends 48 of the tension cords 46 (See FIG. 8). The wheels 70, 72, and 76 are mounted to the side walls 160. Also, the positioning plate 52 is secured by a mounting flange on the plate 52 to the top plate 40.

The carriage housing 40 can be made from a single aluminum plate, with the side walls being bent downwardly, and the forward end 162 also being bent downwardly.

To describe the overall operation of the present invention, the support frame 12 is assembled as shown in FIG. 3, and the carriage assembly 14 is assembled as shown in FIG. 4. As can be seen in FIG. 5, the tension cords 46 are initially mounted in the carriage assembly 14 by moving the anchor end 48 of each cord upwardly through the related vertical slot 152 so that the anchor end 48 is positioned in its related upper opening 154. Each cord 46 extends around it respective pulley 56 and then it is extended forwardly with the operating end being positioned in the center of the stowing opening 156.

In the stowed position the tension force in each of four center cords 46 is about six pounds, and three pounds in each of the outside cords 46.

With the carriage assembly 14 in its assembled condition, this assembly 14 can then be positioned in the Frame 12 by moving the rollers 70, 72 and 76 into engagement with the rails 16. A stop member can be placed at the rear end of the frame 12 in alignment with one of the rear wheels 72 to retain the charge assembly 14 position within the frame 12.

With all of the tensioning cords 46 having the operating end 50 in the stowed position on the carriage 36, the carriage assembly 14 can be moved freely along the length of the Frame 12. To position the apparatus 10 in its operating condition, one or more of the handles 138 of the tensioning cords 46 are pulled forwardly, and then positioned just forward of the related slot 88 in the connecting member 30 and released so that the handle 138 is engaged in the related opening 86.

Then the person positions himself (or herself) fowardly of the machine and in one mode of operation places the person's foot or the person's feet against the contact plate 38, with the feet being positioned underneath the strap 126. Then the person pushes rearwardly against the tensioning of the cord or cords 46. As more cords are put in the operating position, the greater the tension force exerted on the carriage assembly 36. It will be noted that when the carriage is at its furthest forward position (see FIG. 5) it is a simple matter simply to pull the cord handle 138 fowardly a short distance and then move the handle 138 downwardly so that the cord 46 slides down into the opening 86. When the handle 138 is released, the tension of the cord pulls the handle 138 forwardly until the operating end 50 of the cord 46 is secured in the related opening 86 in the connecting plate 30.

The carriage assembly 14 and more particularly the tensioning system 44 is so arranged that the length dimension "a" in FIG. 5 of the two cable sections with the carriage unit 36 in its most forward position is about 18 inches. The total longitudinal movement of the carriage unit 36 from its most forward position to the most rear position is about 16 inches, which is about an equal distance, or a little bit less than an equal distance, relative to the length. Accordingly, when the cords 46 are stretched, the maximum stretching is about 50 percent, and actually a little bit less than 50 percent, of their total length. This enables a desirable elastic cord material to be used, without being over stretched.

Figure 12:
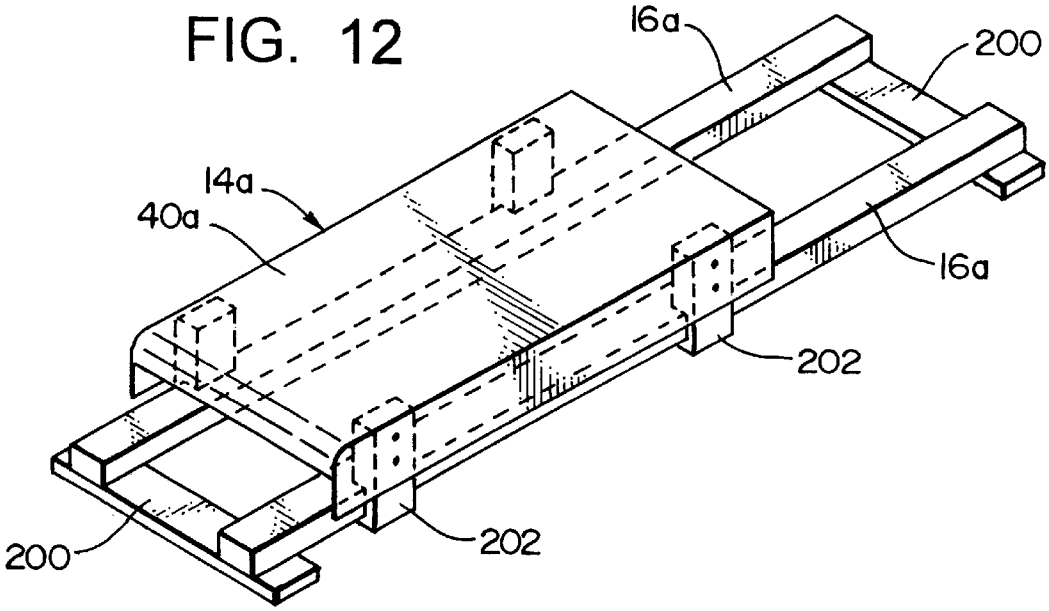
FIG. 12 is an isometric view showing somewhat schematically a modified form of the carriage and the support frame.
Figure 13:
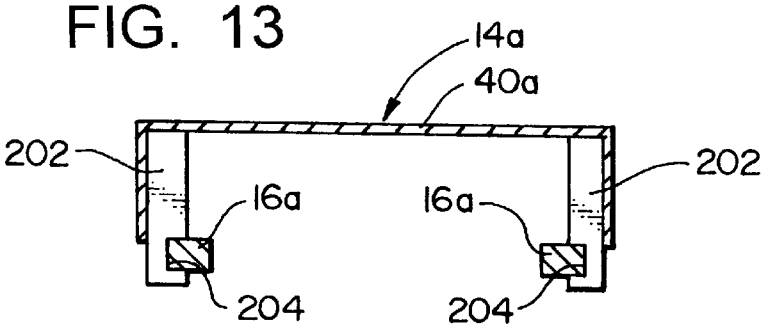
FIG. 13 is a transverse view, partly in section, showing the modified frame and carriage construction of FIG. 12.

FIGS. 12 and 13 show a second embodiment of the present invention which is indicated somewhat schematically. There is a carriage frame 12*a* comprising two longitudinally extending rail members 16*a* joined by cross members 200. There is a carriage assembly 14*a* and in the illustration in FIG. 12, this is simply shown as tho carriage housing 40*a*.

The two rails 16*a* are simply made as elongate beam members having a rectangular configuration. There are four corner track support members 202 formed as rectangular blocks, each of these blocks 202 having a rectangular cutout 204 to engage the related rail member 16*a*.

The rail members 16*a* can conveniently be made from rectangular tubular aluminum extrusions. The support blocks 202 can be made from low friction plastic blocks. It has been found that in the second embodiment of FIGS. 12 and 13, the carriage assembly 14*a* can move back and forth with substantially no friction, yet being held reliably in its proper alignment.

Figure 14:
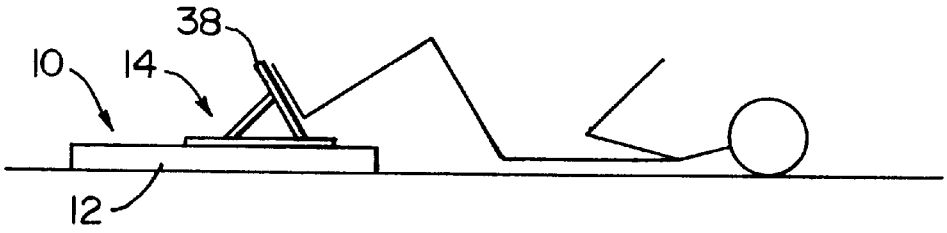
FIGS. 14, 15 and 16 are schematic views showing three different operating modes of the apparatus.
Figure 15:
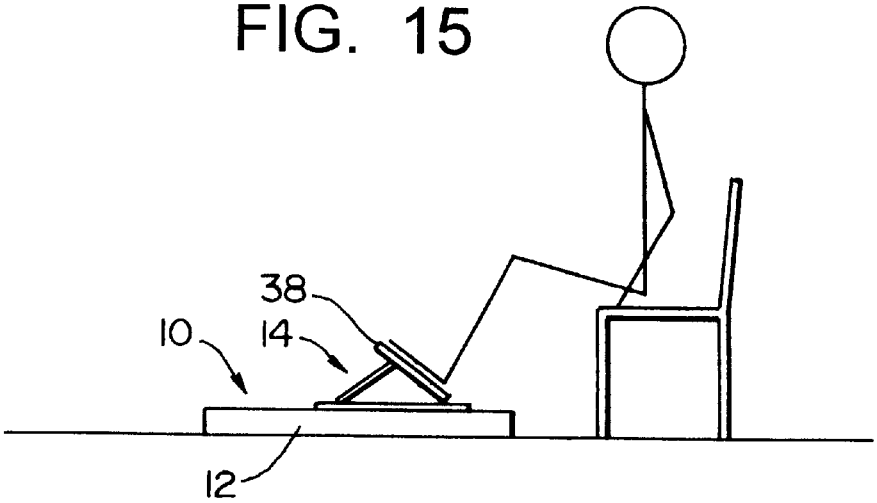
Figure 16:
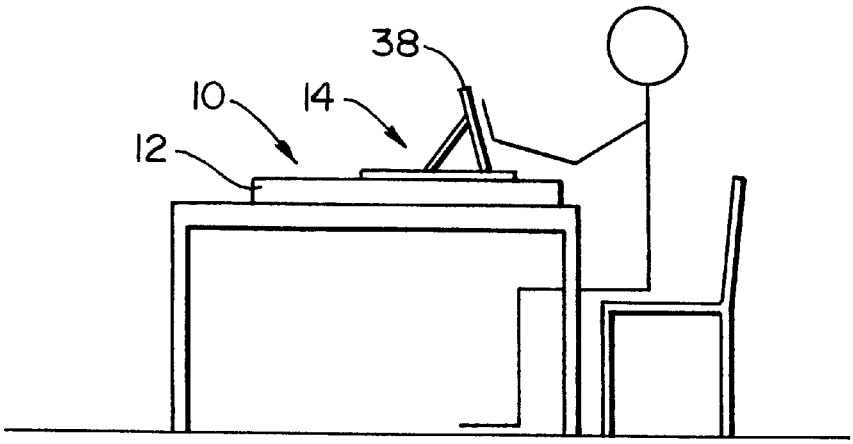

FIGS. 14, 15, and 16 show three different operating modes of the present invention, these being shown rather schematically. In FIG. 14, the person is lying on his back, and the contact plate 38 is positioned at the appropriate angle. In FIG. 15, the person is shown sitting, either in a chair (or possibly a wheel chair), and the contact plate is at a smaller angle relative to the horizontal plane. In FIG. 16, the person is shown at a sitting position, pressing his hands against the contact plate, and the plate is at a steeper angle. In each instance, the stabilizing cords 22 are utilized and adjusted To the proper length to secure the apparatus in the proper position. Various modifications could be made to the present invention without departing from the basic teachings thereof. The various terms used to describe the components of the present invention, are, in the broader claims, intended to be interpreted in a broader sense to include corresponding components which perform same or similar functions. Thus, when a term such as "plate", "knob", "slot" are used in the claims, these are not intended to be interpreted literally by a dictionary definition, but should be interpreted to extend to components which perform like functions.

Now, therefore I claim:

1. An exercise apparatus comprising:

a) a support frame having a front end, a rear end, and a longitudinal axis, said support frame comprising a longitudinally extending rail means;

b) a carriage assembly comprising:

i. a carriage unit mounted to the support frame and engaging the rail means for back and forth travel along the longitudinal axis;

ii. a contact member mounted to the carriage unit and adapted to be engaged by a person to exert a rearwardly directed force on the contact member;

c) said carriage unit having a front end and a rear end and comprising:

i.) a carriage housing;

ii.) rail engaging support means to engage the rail means for said back and forth travel;

iii.) a tensioning system arranged for operative engagement between the carriage assembly and the support frame to exert a forward force on the carriage assembly to urge the carriage assembly in a forward direction;

d) said tensioning system comprising:

i.) a plurality of selectively operable elastic tension cords, each having an anchor end which is connected at a forward location on the carriage assembly to a first anchoring attaching portion of the carriage assembly and an operating attachment end by which said operating attachment end can be selectively attached;

ii.) a second cord attaching portion of the carriage assembly located at the forward end of the carriage assembly and comprising a a second stowing attaching portion to engage selectively the operating attachment ends of the cords at selectively engaged stowing locations at the forward end of the carriage;

iii.) a pulley section located at the rear end of the carriage assembly and comprising a plurality of pulleys, engaging related cords, with the cords extending from the forward anchoring location rearwardly to extend around related pulleys, and then forwardly from the pulleys to a forward location of the carriage assembly;

iv.) a third selectively engaged attaching portion mounted at a front end location of the support frame to connect selectively to the operating attachment ends of the cords, whereby the operating attachment ends of the cords can be attached to the second attaching portion of the carriage assembly so that the cords are in a stowed position in the carriage assembly, and one or more of the operating attachment ends of the cords can be detached from the second attaching portion and engaged with the third selectively engaged attaching portion, so that when a person is utilizing the apparatus by pushing against the contact member to move the carriage assembly rearwardly, one or more tension cords attached to the third attaching portion exert a tension force on the carriage assembly to return the carriage assembly to a more forward location.

2. The apparatus as recited in claim 1, wherein said contact member comprises a contact plate which is adjustably mounted to the carriage housing so as to be able to be positioned at a plurality of angular positions.

3. The apparatus as recited in claim 2, wherein said plate is pivotly mounted at a forward location on the carriage housing, and said plate can be moved angularly in an upward or downward direction from said pivot location, plate positioning means to hold the plate means at selected angular locations.

4. The apparatus as recited in claim 1, further comprising stabilizing cord means having one end attached to the support frame, and a second end having at least one connector adapted to be connected to a stationary structure so as to position the apparatus at a selected operating location.

5. The apparatus as recited in claim 4, wherein said stabilizing cord means comprises a pair of stabilizing cords connected at forward locations on the support frame on opposite sides thereof.

6. The apparatus as recited in claim 5, wherein said stabilizing cords have a length adjustment means incorporated therein so that the stabilizing cords can be connected to structures adjacent to the person operating the exercise apparatus.

7. The apparatus as recited in claim 1, wherein said rail means comprises a pair of laterally spaced rail members, each having upwardly and downwardly directed generally horizontal positioning surfaces to engage the rail engaging means of the carriage to unit limit vertical movement of the carriage assembly relative to the support frame.

8. The apparatus as recited in claim 7, wherein the rail engaging support means comprises first and second wheel means on opposite sides of the carriage unit to engage the upward and downwardly directed surfaces of the rail means.

9. The apparatus as recited in claim 8, wherein said first and second wheel means each comprises a pair of longitudinally spaced support wheels which engage the upwardly directed surface of its related rail member, and a stabilizing wheel positioned between the first and second wheels, and engaging the downwardly directed surface of its related rail member.

10. The apparatus as recited in claim 8, wherein each of the upwardly directed surfaces of the two rail members comprises an upwardly and laterally directed support surface portion providing lateral stabilizing forces to said wheels.

11. The apparatus as recited in claim 7, wherein said rail engaging support means comprises first and second laterally spaced slide blocks, with each of said slide blocks comprising first and second longitudinally spaced slide blocks having upwardly and downwardly directed contact surfaces to engage, respectively, downwardly and upwardly directed positioning surfaces of the rail members, said slide blocks frictionally engaging the rail members.

12. The apparatus as recited in claim 1, wherein said first and second cord attaching portions of the tensioning system each comprises an attaching structure having attaching slots for the cord operating attachment ends, each attaching slot being sized to permit its related cord to pass there through, and having first and second enlarged openings, said anchor end of each cord having an enlarged end portion which is sized to engage the edge portions of attaching structure at the first opening to attach the anchor end of the cord to the attaching structure, and the operating attachment end of each cord also having a sufficiently large end portion to become engaged in the second opening of the attaching structure to retain the operating attachment end at the position of the second opening.

13. The apparatus as recited in claim 12, wherein each of said slots has a third opening which is aligned so that with the operating end of its related cord being positioned in the third attaching means, lateral movement of the cord is restrained by said third opening means.

14. The apparatus as recited in claim 13, wherein said attaching structure is mounted at a forward end of said carriage housing to extend downwardly therefrom, and said slots comprise downwardly extending slots, having an open lower end, with said first and second openings being vertically aligned with another, said third attaching means having upwardly open slots, with enlarged openings formed therein, and the enlarged openings of the third attaching means are in longitudinal alignment lower than the second openings of the attaching structure of the carriage assembly.

15. An exercise apparatus comprising:

a) a support structure having a front end, a rear end, and a longitudinal axis;

b) a carriage assembly comprising mounted to the support structure for back and forth travel along the longitudinal axis and having a contact portion adapted to be engaged by a person to exert a rearwardly directed force on the contact member, said carriage unit having a front end and a rear end;

c) a tensioning system arranged for operative engagement between the carriage assembly and the support structure to exert a forward force on the carriage assembly to urge the carriage assembly in a forward direction, said tensioning system comprising:

i.) a plurality of selectively operable elastic tension cords, each having a first anchor end attached to a forward portion of the carriage assembly, and a second end;

ii.) a carriage cord attaching portion which is located at the forward portion of the carriage assembly and to which each of the second ends of the cords can be selectively attached;

iii.) a support structure cord attaching portion which is located at a forward part of the support structure and to which each of the second ends of the cords can be selectively attached;

iv.) a pulley section which is located at a rear portion of the carriage assembly;

v.) the cords being positioned to extend from a forward anchoring location at the forward portion of the carriage rearwardly to extend around the pulley section, and then forwardly from the pulley section to be selectively attached to the carriage cord attaching portion or to the support structured attaching portion;

whereby the second ends of the cords can be attached to the carriage cord attaching portion so that the cords are in a stowed position and on or more of the second ends of the cords can be detached from the carriage cord attaching portion and attached to the support structure cord attaching portion so that when a person is utilizing the apparatus by pushing against the contact portion to move the carriage assembly rearwardly, the one or more tension cords attached to the support structure cord attaching portion exert a tension force on the carriage assembly to return the carriage assembly to a more forward location.

16. The apparatus as recited in claim 15, wherein said carriage cord attaching portion of the carriage assembly and the support structure attaching portion of the support structure are both located at an accessable forward location in said apparatus and the second selectively attachable ends of the cords are also accessable at the forward end of the apparatus so that the second ends of the cords can be removed between the stowed postion and an operating position where one or more of the cord end portion are connected to the support structure attaching portion.

17. The apparatus as recited in claim 16, wherein said carriage assembly has forward and rear end travel locations, and with the carriage assembly being located at the forward travel location, the carriage cord attaching portion and the support structure attaching portions are positioned proximate to one another to facilitate movement of the second end of the cords between the stowed position and the operating position.

18. The apparatus as recited in claim 17, wherein said carriage cord attaching portion has a plurality of laterally spaced connecting locations, and said cords are spaced laterally in general alignment with related cord connecting locations, and the support struture attaching portion has a plurality of support structure connecting locations which are aligned adjacent to corresponding attaching locations of the carriage cord attaching portion.

19. The apparatus as recited in claim 15, wherein said carriage cord attaching portions has a plurality of laterally spaced connecting locations, with a plurality of laterally spaced open slots having open slot ends, and said support structure attaching portion has a plurality of laterally spaced support structure slots having an open end, the open ends of the carriage cord attaching portion and of the support structure connecting portion opening to a region through which the second ends of the cords can be moved so as to be moved through said region from one of said carriage cord attaching portion and said support structure attaching portion to the other.

20. The apparatus as recited in claim 19, wherein the slots of the carriage cord attaching portion open vertically downwardly, and the slots of the support structure attaching portion open upwardly.

21. The apparatus as recited in claim 15, wherein the first anchor ends of the cords are located at laterally spaced upper locations, and the said carriage cord attaching portion has a plurality of carriage attaching locations positioned in general alignment with, and at a level below, a level of said first anchor locations, and said cords extend to the pulley section thence downwardly around said pulley section and back to the carriage cord attaching portion.

22. The apparatus as recited in 21, wherein said support structure attaching portion has a plurality of laterally spaced support structure connecting locations which are aligned with the connecting locations of the carriage cord attaching locations.

23. The apparatus as recited in claim 21, wherein the connecting locations fo the support structure attaching portion are located below the level of the carriage cord attaching locations, so that the second ends of the cords are moved from the carriage cord attaching locations downwardly to connect at the support structure cord attaching locations.

* * * * *